US010230190B2

(12) United States Patent
Frimmersdorf

(10) Patent No.: US 10,230,190 B2
(45) Date of Patent: Mar. 12, 2019

(54) CONTACT TERMINAL ASSEMBLED FROM AT LEAST TWO PARTS

(71) Applicant: Delphi Technologies, LLC, Troy, MI (US)

(72) Inventor: Gregor Frimmersdorf, Solingen (DE)

(73) Assignee: DELPHI TECHNOLOGIES, LLC, Troy, MI (US)

( * ) Notice: Subject to any disclaimer, the term of this patent is extended or adjusted under 35 U.S.C. 154(b) by 0 days.

(21) Appl. No.: 15/954,859

(22) Filed: Apr. 17, 2018

(65) Prior Publication Data

US 2018/0309219 A1 Oct. 25, 2018

(30) Foreign Application Priority Data

Apr. 19, 2017 (EP) ..... 17167072

(51) Int. Cl.
*H01R 13/40* (2006.01)
*H01R 13/15* (2006.01)
*H01R 43/16* (2006.01)

(52) U.S. Cl.
CPC ..... *H01R 13/15* (2013.01); *H01R 43/16* (2013.01)

(58) Field of Classification Search
CPC .. H01R 13/4223; H01R 12/57; H01R 13/115; H01R 13/111; H01R 4/20
USPC ..... 439/752.5, 876, 849, 851, 948
See application file for complete search history.

(56) References Cited

U.S. PATENT DOCUMENTS 5,634,825 A * 6/1997 Maki ..... H01R 13/112 439/745
5,938,485 A 8/1999 Hotea et al.
5,938,486 A 8/1999 Durand-Cochet et al.
6,293,832 B1 * 9/2001 Yamamoto ..... H01R 13/113 439/850
6,478,635 B2 * 11/2002 Charles ..... H01R 4/185 439/851
6,544,080 B1 * 4/2003 Yamamoto ..... H01R 13/113 439/849
8,827,754 B2 * 9/2014 Lee ..... H01R 13/113 439/843
9,011,186 B2 4/2015 Wirth et al.

FOREIGN PATENT DOCUMENTS

DE 19813067 A1 10/1998
EP 653807 A1 5/1995
EP 2328236 A1 6/2011

* cited by examiner

*Primary Examiner* — Phuong Chi T Nguyen
(74) *Attorney, Agent, or Firm* — Robert J. Myers

(57) ABSTRACT

A contact terminal is assembled from parts including a base part and a sleeve. The base part has a plurality of contact tongues aligned along a mating axis and configured to contact a male connector pin by contact surfaces on the plurality of contact tongues. The sleeve is configured to be arranged at least partially over the base part, the sleeve having a spring element. The spring element is configured to contact the plurality of contact tongues on a side opposite to the contact surfaces side. The spring element comprises a first arm, a second arm, and a flexible support structure therebetween. The first arm and the second arm protrude from the sleeve along the mating axis inside the sleeve. The flexible support structure undulates from the first arm to the second arm.

15 Claims, 4 Drawing Sheets

CONTACT TERMINAL ASSEMBLED FROM AT LEAST TWO PARTS

CROSS-REFERENCE TO RELATED APPLICATION

This application claims the benefit under 35 U.S.C. § 119(a) of Patent Application No. 17167072.2 filed in the European Patent Office on Apr. 19, 2017, the entire disclosure of which is hereby incorporated by reference.

TECHNICAL FIELD OF THE INVENTION

The invention generally relates to a contact terminal, and in particular to a contact terminal which is assembled from at least two parts.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Figure 1:
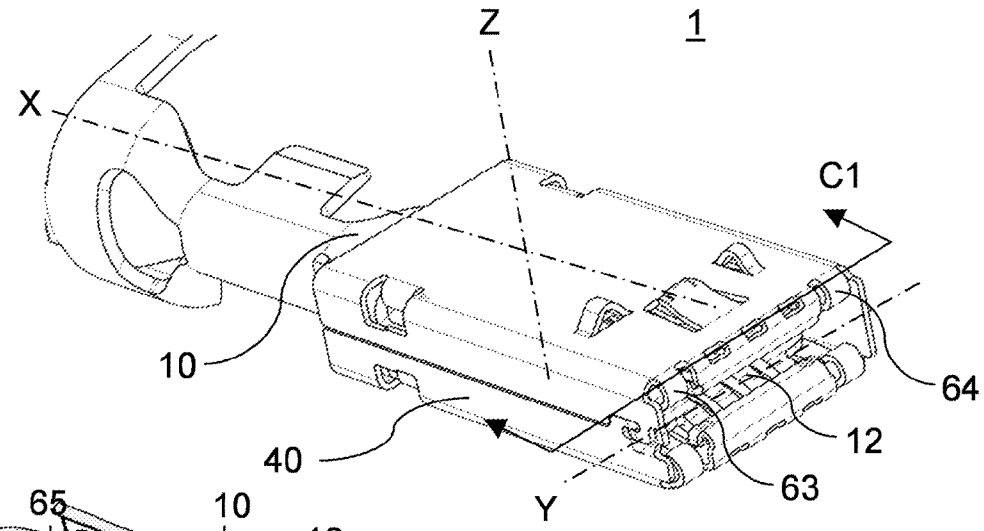
FIG. 1 shows a contact terminal in perspective view according to one embodiment.

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

A non-limiting example of a contact terminal assembled from at least two parts is described herein. The contact terminal includes a base part, having a plurality of contact tongues aligned along a mating axis and is configured to contact a male connector pin by contact surfaces on the plurality of contact tongues. A sleeve is configured to be arranged at least partially over the base part. The sleeve has a spring element. The spring element is configured to contact the plurality of contact tongues on a backside opposite to the contact surfaces side. The spring element comprises a first arm, a second arm, and a flexible support structure therebetween. The first arm and the second arm protrude from the sleeve along the mating axis inside the sleeve. The flexible support structure is undulating from the first arm to the second arm.

The spring element of the sleeve may provide the entire contact force. It is a benefit of a contact terminal to separate the two functions of providing electrical and/or thermal contact and providing a time-independent contact force to a connector pin. The contact tongue of the base part can be designed to exclusively provide an electrical and/or a thermal contact to the connector pin, whereas the spring element of the sleeve can be constructed to exclusively provide the contact force to fix the connector pin in the contact terminal. The separation of the two functions allows optimizing the contact tongue for an optimal electrical and/or thermal contact to the connector pin and/or to a cable connected to the contact terminal. The sleeve, or to be more precisely the spring element, can be drafted providing a contact force which is essentially independent of the operation time and the operation temperature (at least up to a temperature of 200° C.) of the contact terminal. The flexible support structure comprises a metal strip with a rectangular cross section that is shaped in an undulating form. The first arm is connected to the first end of the metal strip and a second arm is connected to the second end of the metal strip. The flexible structure is only at two points that are distanced from each other, connected to the sleeve. That makes the flexible structure movable along the mating axis as well perpendicular. The flexible structure can be easy configured to the application in design phase, because the characteristics of material and geometry are well known. The undulating geometry of the supporting spring provides an individual supporting element to each receptacle body lever which is exerting its force in one point to this beam and in opposite direction in two points to the hoods wall. This design provides a shallow and even force vs shift behavior which is capable to compensate a large range of manufacturing deviations and therefor is capable to provide a robust manufacturing process. Moreover each bar is facilitated to expand during its contact force generating shift to a side either front to back side directed or in both directions coincidental. This renders the contact normal force evaluation won't depend on the actuating direction. Since each bar is born individually the design is capable to compensate missing contact points e.g. due to misaligned mating tabs or deviating tab width dimensions.

The sleeve may have a rectangular cross-section and the flexible support structure extends perpendicular to the mating axis. This design works with standard blade terminals. The flexible support structure can be used on one side on both sides of the sleeve.

Alternatively, the sleeve may have a round cross-section and the flexible support structure surrounds, at least partly, the plurality of contact tongues. A round cross-section terminal, designed to cooperate with pin shaped counter connector, using the flexible support structure.

The flexible support structure may be arranged parallel to the inner surface of the sleeve inside the sleeve. This design is easy to manufacture and requires little space inside the sleeve.

The flexible support structure may extend in a zigzag shape perpendicular to the mating axis. The zigzag shaped flexible structure is easy to manufacture. The contact points to the inner surface of the sleeve are small and the position well defined. Spring support does not need a certain contact geometry since it is just providing the force w/o regard to the property of the electrical contact point.

The zigzag shape may be defined by a plurality of straight strips. The strips are arranged lateral to each other and angled to the mating axis. The straight strips are connected at their straight strip ends. The zigzag shape made of the plurality of straight strips it is easy to manufacture and design and provides the opportunity to form all the lever in one by one common tooling.

The plurality of straight strips may be deformed in between of the straight strip ends towards the plurality of contact tongues, defining a plurality of support areas for the plurality of contact tongues. The deformation can be applied into the straight strips as desired in the application. The flexibility of the support and the contact point where the deformation contacts the contact tongue can be defined in design phase.

The flexible support structure may extend in the shape of a rectangular wave. This design may vary e.g. to a sinusoidal shape dependent to the force evaluation characteristics necessary to be supplied. This design is easy to manufacture and requires little space inside the sleeve. Furthermore the straight strips can be arranged side-by-side close to each other, to support contact tongues that are also arranged close to each other. This design allows quite compact terminals with a plurality of supported contact tongues.

The rectangular wave shape may be defined by a plurality of straight strips, wherein a first set of straight strips is arranged lateral to each other and along the mating axis, and wherein a second set of straight strips is arranged lateral to each other and perpendicular to the mating axis, wherein the straight strips are connected at their straight strip ends. This connecting profile allows to control the characteristic of spring behavior along with the property to provide a robust assembly process hood to body.

The plurality of straight strips of the first set of straight strips may be deformed in between of the straight strip ends towards the plurality of contact tongues, defining a plurality of support areas for the plurality of contact tongues. The deformation can be applied into the straight strips as desired in the application. The flexibility of the support and the contact point where the deformation contacts the contact tong can be defined in design phase.

The plurality of straight strips may be deformed by kinking the plurality straight strips and defining edge shaped support areas. Edge shaped support areas provide an advantageous solution when very precise contact points of the support areas to the contact tongues are required. Another application for edge shaped support areas could be, for some reasons, reducing the flexibility of the straight strips.

The plurality of support areas may be arranged along a transversal axis perpendicular to the mating axis whereby each single support area is in communication with a single contact tongue. This design makes sure that all contact tongues are pretension with an equal force. Every single contact tongue is supported by an independent single straight strip.

The straight strip ends may be arranged along a transversal axis, perpendicular to the mating axis.

The straight strip ends may be in communication with an inner surface of the sleeve. The straight strips ends are supported by the inner surface. While inserting the counter connector the straight strip ends are pressed against the inner surface. Because the straight strip ends are not fixed to the inner surface, they can move a little along the inner surface, responding to the insertion.

The sleeve and the spring element may be made integrally from sheet-metal. To make the sleeve integrally from one sheet-metal reduces costs while manufacturing and design phase.

FIG. 1 shows a contact terminal 1 assembled from at least two parts, comprising a base part 10, having a plurality of contact tongues 12 aligned along a mating axis X and configured to contact a male connector pin by contact surfaces 13 (see FIG. 4) on the plurality of contact tongues 12. A sleeve 40 configured to be arranged at least partially over the base part 10. A first arm 63 and a second arm 64 protrude from the sleeve 40, along the mating axis X inside the sleeve 40. The sleeve 40 has a rectangular cross-section and the sleeve walls are aligned along a transversal axis Y and a vertical axis Z. The transversal axis Y is arrange perpendicular to the mating axis X and the vertical axis Z. The vertical axis Z is arrange perpendicular to the mating axis X and the transversal axis Y.

Figure 2:
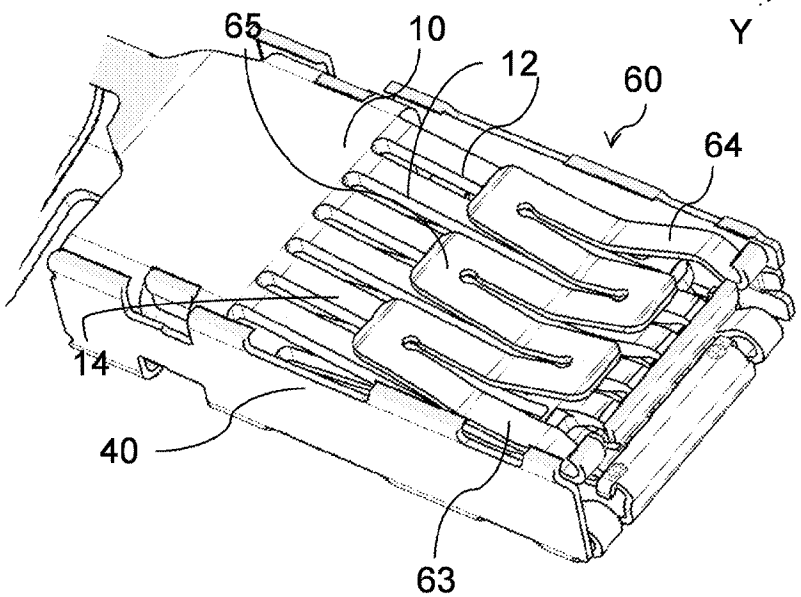
FIG. 2 shows a cross section of the contact terminal of FIG. 1 according to one embodiment.

FIG. 2 shows a cross section view of FIG. 1 wherein the cut is performed along cut line C1. The sleeve 40 has a spring element 60, wherein the spring element 60 is configured to contact the plurality of contact tongues 12 on a backside 14 (see FIG. 6) opposite to the contact surfaces side 12 (see FIG. 4). The spring element 60 comprises a first arm 63 and a second arm 64 and a flexible support structure 65 in between. The first arm 63 and the second arm 64 protrude from the sleeve 40, along the mating axis X inside the sleeve 40, wherein the flexible support structure 65 is undulating from the first arm 63 to the second arm 64. The sleeve 40 has a rectangular cross-section and the flexible support structure 65 extends perpendicular to the mating axis X.

Figure 3:
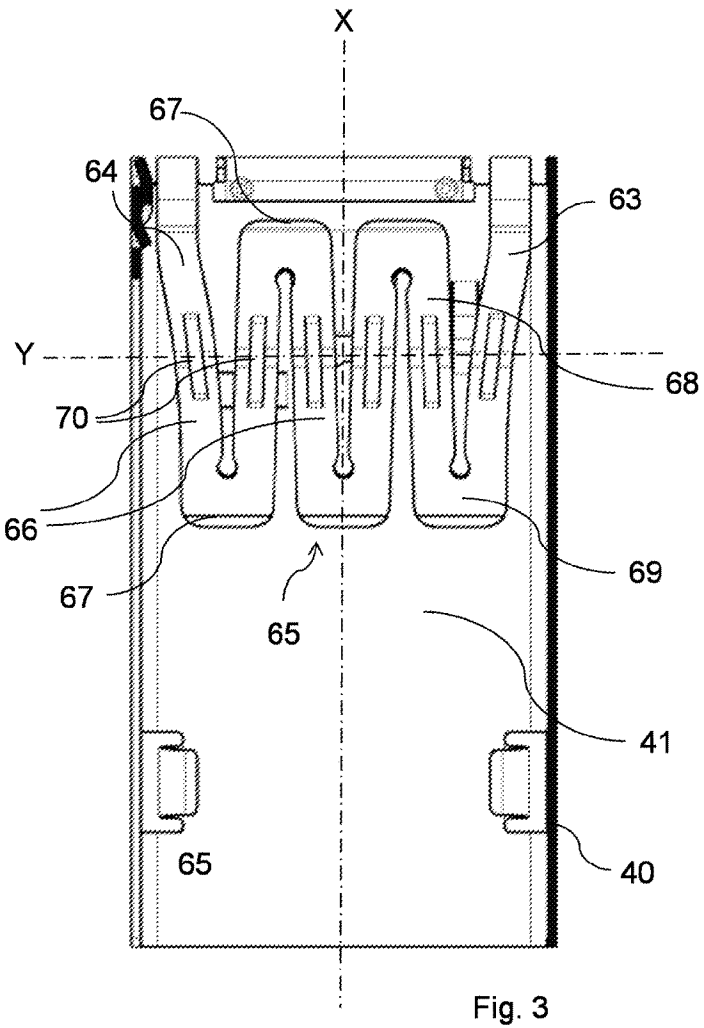
FIG. 3 shows the inner design of the sleeve in the top view according to one embodiment.

FIG. 3 shows the inner design of the sleeve 40 comprising the spring element 60. For better visibility half of the sleeve 40 is removed. The flexible support structure 65 is arranged parallel to the inner surface 41 of the sleeve 40 inside the sleeve 40. The plurality of straight strips 66 is deformed in between of the straight strip ends 67 towards the plurality of contact tongues 12, defining a plurality of support areas 70 for the plurality of contact tongues 12. The flexible support structure 65 extends in shape of a rectangular wave along the transversal axis Y. The rectangular wave shape is defined by a plurality of straight strips 66, wherein a first set of straight strips 68 is arranged lateral to each other and along the mating axis X, and wherein a second set of straight strips 69 is arranged lateral to each other and perpendicular to the mating axis X, wherein the straight strips 66 are connected at their straight strip ends 67. The straight strip ends 67 are arranged along a transversal axis Y, perpendicular to the mating axis X. A plurality of support areas 70 are arranged along a transversal axis Y perpendicular to the mating axis X whereby each single support area is in communication with a single contact tongue 12 (see FIG. 6).

Figure 4:
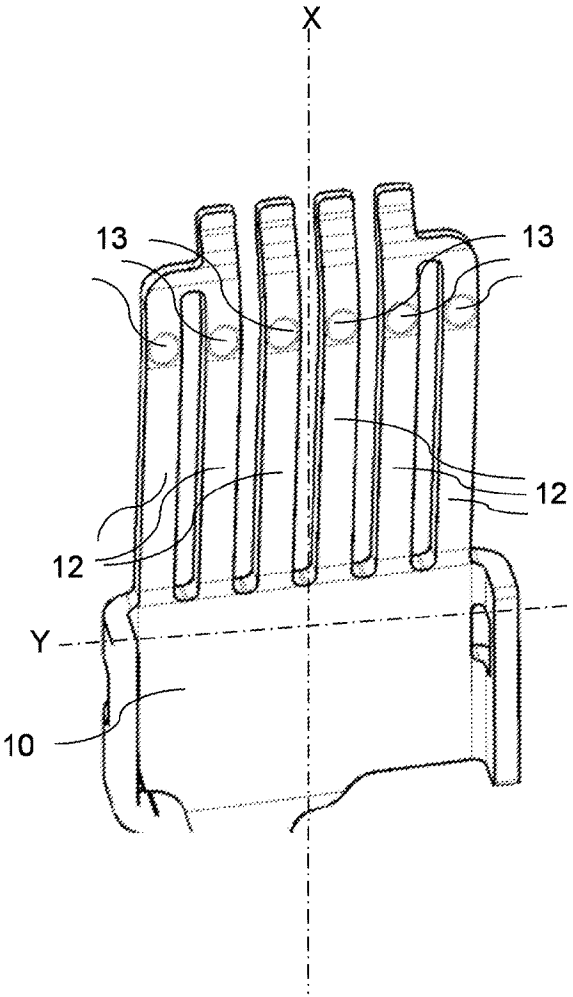
FIG. 4 shows the base part in the perspective view according to one embodiment.

FIG. 4 shows the base part 10, having a plurality of contact tongues 12, aligned along a mating axis X, configured to contact a male connector pin by contact surfaces 13 on the plurality of contact tongues 12. The free ends of the contact tongues 12 are configured to cooperate with the front part of the sleeve 40 in a way that the free ends are flexed towards the inner surface 41 of the sleeve 40. The spring element 60 is arranged between the inner surface 41 of the sleeve 40 and the contact tongues 12 due to this flexible support is provided to the contact tongues 12 especially to the contact surfaces 13.

Figure 5:
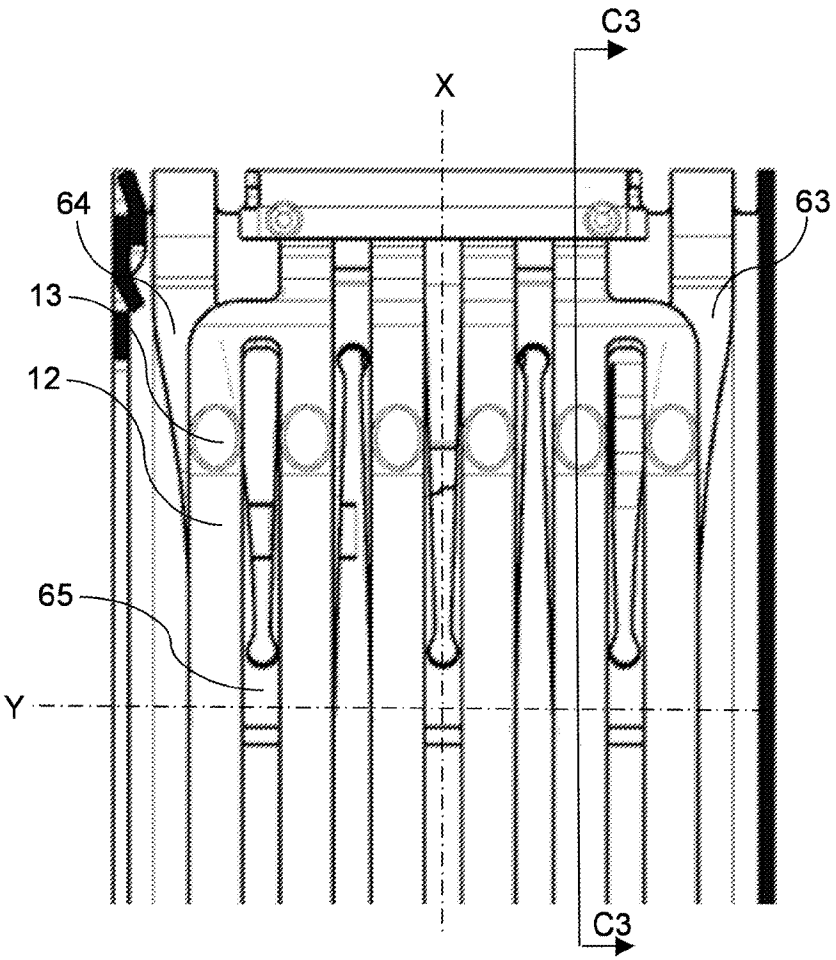
FIG. 5 shows a detailed view of the inside of the sleeve in a top view according to one embodiment.

FIG. 5 shows a detailed view of the inside of the sleeve 40 comprising the spring element 60 and the plurality of contact tongues 12 wherein all parts are assembled in the final position. For better visibility half of the sleeve 40 and half of the base part 10 are removed. Each contact tongue 12 is supported by one of the straight strips 66 arranged between the contact tongue 12 and the inner surface 41 of the sleeve 40. For better illustration how the flexible support works, a cut is performed along cut line C3 and shown in FIG. 6.

Figure 6:
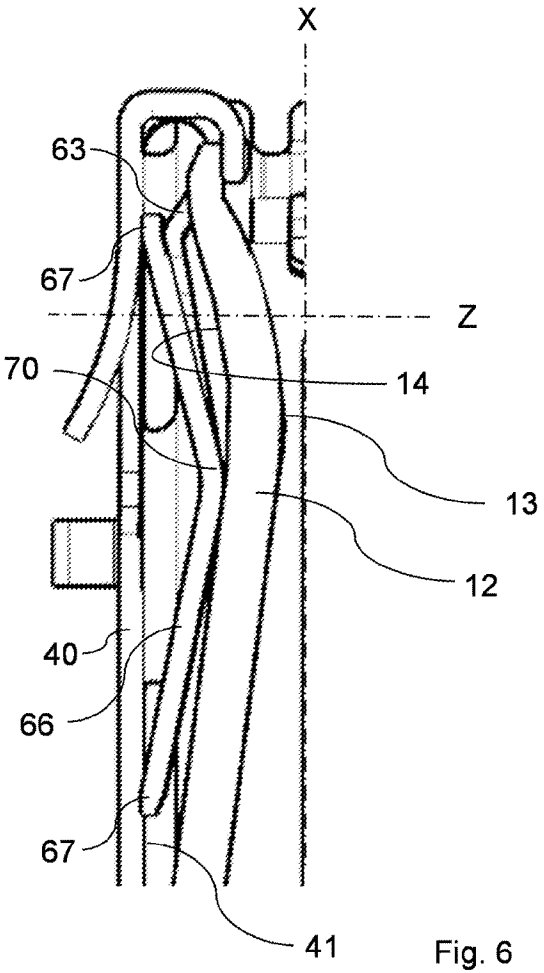
FIG. 6 shows a cut view of the arrangement shown in FIG. 5 according to one embodiment.

FIG. 6 shows a cut view of the arrangement shown in FIG. 5, whereby the cut was performed along the cut line C3. The plurality of straight strips 66 of the first set of straight strips 68 is deformed in between the straight strip ends 67 towards the plurality of contact tongues 12, defining a plurality of support areas 70 for the plurality of contact tongues 12. In this embodiment the plurality of straight strips 68 are deformed by kinking the plurality straight strips 66, thereby defining edge shaped support areas 70. The straight strip ends 67 are in communication with the inner surface 41 of the sleeve 40.

Figure 7:
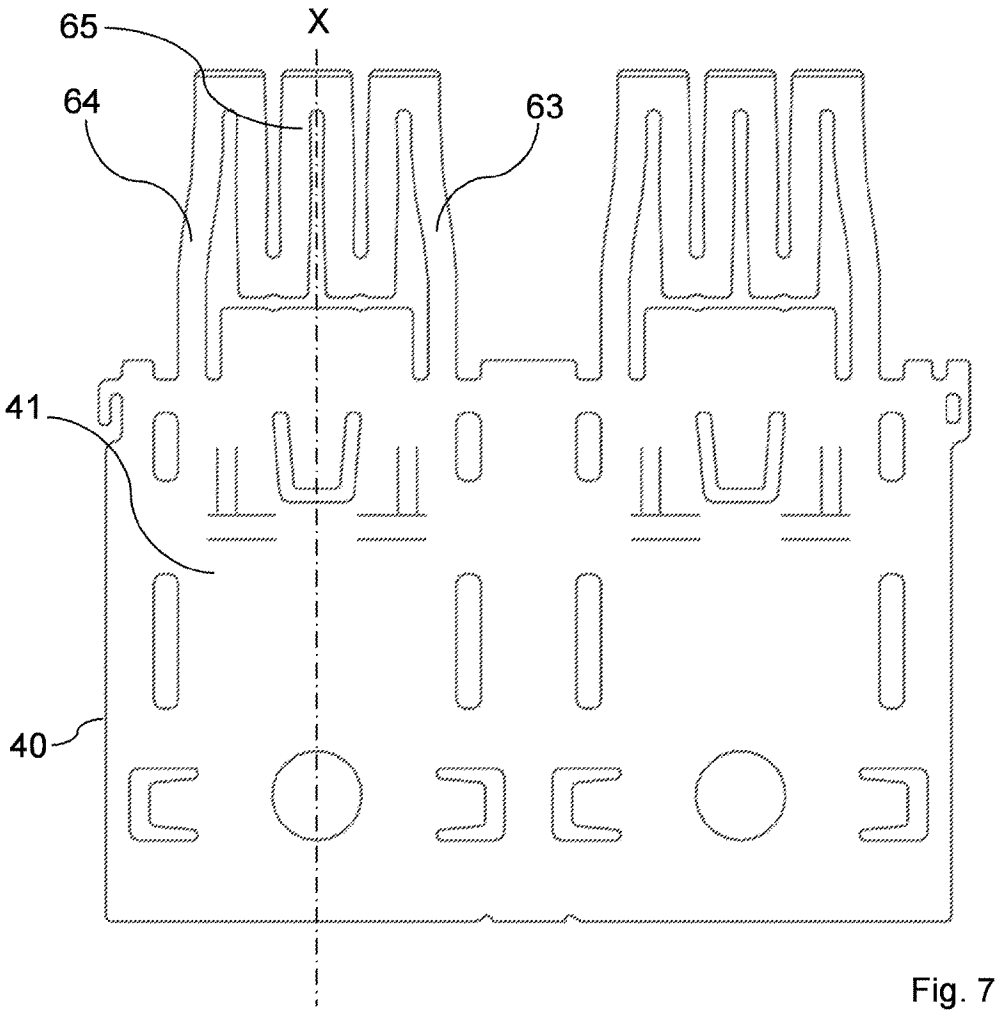
FIG. 7 shows a plane view on a stamped metal sheet that will be formed to the sleeve according to one embodiment.

FIG. 7 shows a plane view on a stamped metal sheet that will be formed to the sleeve 40.

While this invention has been described in terms of the preferred embodiments thereof, it is not intended to be so limited, but rather only to the extent set forth in the claims that follow. For example, the above-described embodiments (and/or aspects thereof) may be used in combination with each other. In addition, many modifications may be made to configure a particular situation or material to the teachings of the invention without departing from its scope. Dimensions, types of materials, orientations of the various components, and the number and positions of the various components described herein are intended to define parameters of certain embodiments, and are by no means limiting and are merely prototypical embodiments.

Many other embodiments and modifications within the spirit and scope of the claims will be apparent to those of skill in the art upon reviewing the above description. The scope of the invention should, therefore, be determined with reference to the following claims, along with the full scope of equivalents to which such claims are entitled.

As used herein, 'One or more' includes a function being performed by one element, a function being performed by more than one element, e.g., in a distributed fashion, several functions being performed by one element, several functions being performed by several elements, or any combination of the above.

It will also be understood that, although the terms first, second, etc. are, in some instances, used herein to describe various elements, these elements should not be limited by these terms. These terms are only used to distinguish one element from another. Moreover, the use of the terms first, second, etc. does not denote any order of importance, but rather the terms first, second, etc. are used to distinguish one element from another. For example, a first contact could be termed a second contact, and, similarly, a second contact could be termed a first contact, without departing from the scope of the various described embodiments. The first contact and the second contact are both contacts, but they are not the same contact.

The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context.

Additionally, directional terms such as upper, lower, etc. do not denote any particular orientation, but rather the terms upper, lower, etc. are used to distinguish one element from another and establish a relationship between the various elements.

I claim:

1. A contact terminal, comprising:

a base part having a plurality of contact tongues aligned along a mating axis and configured to contact a male connector pin by contact surfaces on the plurality of contact tongues; and a sleeve configured to be arranged at least partially over the base part, said sleeve having a spring element, wherein the spring element is configured to contact the plurality of contact tongues on a backside opposite to the contact surfaces side, wherein the spring element comprises a first arm, a second arm, and a flexible support structure therebetween, wherein the first arm and the second arm protrude from the sleeve along the mating axis inside the sleeve, and wherein the flexible support structure is undulating between the first arm to the second arm.

2. The contact terminal according to claim 1, wherein the sleeve has a rectangular cross-section and wherein the flexible support structure extends perpendicular to the mating axis.

3. The contact terminal according to claim 1, wherein the sleeve has a round cross-section and the flexible support structure at least partly surrounds the plurality of contact tongues.

4. The contact terminal according to claim 1, wherein the flexible support structure is arranged parallel to an inner surface of the sleeve inside the sleeve.

5. The contact terminal according to claim 1, wherein the sleeve and the spring element are integrally formed from sheet-metal.

6. The contact terminal according to claim 1, wherein the flexible support structure extends in a zigzag shape perpendicular to the mating axis.

7. The contact terminal according to claim 6, wherein the zigzag shape is defined by a plurality of straight strips, wherein the plurality of straight strips are arranged lateral to each other and angled to the mating axis, and wherein the plurality of straight strips are connected at their straight strip ends.

8. The contact terminal according to claim 7, wherein the plurality of straight strips is deformed between the straight strip ends towards the plurality of contact tongues and wherein the plurality of straight strips define a plurality of support areas for the plurality of contact tongues.

9. The contact terminal according to claim 1, wherein the flexible support structure extends in a rectangular wave shape.

10. The contact terminal according to claim 9, wherein the rectangular wave shape is defined by a plurality of straight strips, wherein a first set of straight strips is arranged lateral to each other and along the mating axis, wherein a second set of straight strips is arranged lateral to each other and perpendicular to the mating axis, and wherein the plurality of straight strips are connected at their straight strip ends.

11. The contact terminal according to claim 10, wherein the plurality of straight strips of the first set of straight strips is deformed between the straight strip ends towards the plurality of contact tongues and wherein the plurality of straight strips define a plurality of support areas for the plurality of contact tongues.

12. The contact terminal according to claim 11, wherein the plurality of straight strips are deformed by kinking the plurality of straight strips and wherein the plurality of straight strips define edge shaped support areas.

13. The contact terminal according to claim 11, wherein the plurality of support areas are arranged along a transversal axis perpendicular to the mating axis, whereby each single support area is in communication with a single contact tongue.

14. The contact terminal according to claim 13, wherein the straight strip ends are arranged along the transversal axis and perpendicular to the mating axis.

15. The contact terminal according to claim 14, wherein the straight strip ends are in communication with an inner surface of the sleeve.

* * * * *